US009214294B2

(12) United States Patent
Maruyama et al.

(10) Patent No.: US 9,214,294 B2
(45) Date of Patent: Dec. 15, 2015

(54) KEY SWITCH DEVICE, AND METHOD OF MANUFACTURING KEY SWITCH DEVICE

(71) Applicant: FUJITSU COMPONENT LIMITED, Tokyo (JP)

(72) Inventors: Junichi Maruyama, Tokyo (JP); Tamotsu Koike, Tokyo (JP); Takeshi Nishino, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 112 days.

(21) Appl. No.: 14/077,344

(22) Filed: Nov. 12, 2013

(65) Prior Publication Data

US 2014/0138234 A1 May 22, 2014

(30) Foreign Application Priority Data

Nov. 19, 2012 (JP) ..... 2012-253570

(51) Int. Cl.

*H01H 13/70* (2006.01)
*H01H 3/12* (2006.01)
*H01H 11/00* (2006.01)

(52) U.S. Cl.

CPC ..... *H01H 3/125* (2013.01); *H01H 11/00* (2013.01); *H01H 2215/008* (2013.01); *Y10T 29/49105* (2015.01)

(58) Field of Classification Search

CPC ..... H01H 3/125–13/26
USPC ..... 200/517, 293, 344, 5 A, 345; 400/495, 400/490, 495.1
See application file for complete search history.

(56) References Cited

U.S. PATENT DOCUMENTS

| | | | | |
|---|---|---|---|---|
| 6,183,150 | B1 * | 2/2001 | Kao | 400/495 |
| 6,257,782 | B1 * | 7/2001 | Maruyama et al. | 400/495.1 |
| 8,299,382 | B2 | 10/2012 | Takemae et al. | |
| 2012/0199458 | A1 | 8/2012 | Takemae et al. | |

FOREIGN PATENT DOCUMENTS

| | | |
|---|---|---|
| JP | 2009-076321 | 4/2009 |
| JP | 2012-182107 | 9/2012 |

* cited by examiner

*Primary Examiner* — Vanessa Girardi
(74) *Attorney, Agent, or Firm* — IPUSA, PLLC

(57) ABSTRACT

A key switch device includes a key top; a link member that guides an elevating operation of the key top while being interlocking with the key top, the link member including a rotatable shaft and a sliding shaft that is connected to the key top; a membrane sheet that includes a contact that opens and closes in accordance with the elevating operation of the key top; a back plate; a housing that holds the rotatable shaft of the link member to the back plate; and a pushing unit that pushes the link member such that the sliding shaft moves away from the back plate.

10 Claims, 12 Drawing Sheets

KEY SWITCH DEVICE, AND METHOD OF MANUFACTURING KEY SWITCH DEVICE

BACKGROUND OF THE INVENTION

1. Field of the Invention

The present invention relates to a key switch device, and a method of manufacturing a key switch device.

2. Description of the Related Art

Thin keyboards are desirable for electronic devices such as notebook personal computers or the like, for example. Thus, key switch devices mounted on the keyboard are desired to have low height. For such a purpose, a key switch device including a key top, a pair of gear links having a "V" shape, a membrane sheet switch and a support plate is provided, as disclosed in Patent Documents 1 and 2, for example.

In the key switch device disclosed in Patent Document 1 or 2, the key top fits the gear links by pressing and fitting hooks of the key top and sliding pins of the gear links. However, when inserting the key top, in other words, before fitting the hooks of the key top and the sliding pins of the gear links, the gear links are positioned at a bottom dead center. Thus, it is necessary to attach the key top while pressing a rubber dome of the membrane sheet switch in order to fit the key top and the gear links.

In such a case, when inserting the key top, as the key top first contacts the unstable rubber dome before contacting the gear links that function as a fixing guide, it is hard to align the position of the key top, and as a result, it is hard to insert the key top. Further, as it is hard to align the position of the key top, an operator needs to be skilled in inserting the key top. Thus, the gear links may be damaged by an unskilled operator.

When inserting the key top, it is necessary to match centers of the rubber dome and the gear links while adjusting positions of the rubber dome and the gear links. However, if the position of the key top is shifted in a lateral direction, it is necessary to correct the position of the key top in the lateral direction while fitting the key top to the gear links. At this time, deformation of the rubber dome easily occurs.

If the rubber dome deforms largely, there may be an unusual feeling in a manufactured key switch device such as a click feeling cannot be obtained, or the click feeling is too small in a keying operation. Thus, a problem may be generated such as percent defective is increased, test steps are increased, deficiency when using the key switch device is generated or the like.

Further, measures in order to prevent the deformation of the rubber dome, such as improving the skill of the operator in inserting the key top, or pulling up the key top when inserting the key top or the like, also cause an increase of manufacturing steps and an increase of cost.

Recently, as a demand for thin keyboards for electronic devices is increasing, the size of the rubber dome is becoming small. Thus, the problem of the deformation of the rubber dome happens more often. It is difficult to form the rubber dome with a small size to be capable of retaining the click feeling while retaining the resistance against a force in the lateral direction.

Further, for a key switch device, there is a demand to reduce a keying sound that is generated while operating the key switch device. Conventionally, the key switch device is configured to reduce the sound generated in a keying operation by an elasticity of the rubber dome when it is compressed at a stroke end. However, as the size of the rubber dome becomes small and the stroke is shortened, it is hard to reduce the sound generated in a keying operation because there is not enough space for the compression of the rubber dome.

PATENT DOCUMENTS

[Patent Document 1] Japanese Laid-open Patent Publication No. 2009-76321

[Patent Document 2] Japanese Laid-open Patent Publication No. 2012-182107

SUMMARY

According to an embodiment, there is provided a key switch device including a key top; a link member that guides an elevating operation of the key top while being interlocking with the key top, the link member including a rotatable shaft and a sliding shaft that is connected to the key top; a membrane sheet that includes a contact that opens and closes in accordance with the elevating operation of the key top; a back plate; a housing that holds the rotatable shaft of the link member to the back plate; and a pushing unit that pushes the link member such that the sliding shaft moves away from the back plate.

According to another embodiment, there is provided a method of manufacturing a key switch device including, a key top, a link member that guides an elevating operation of the key top, the link member including a rotatable shaft and a sliding shaft that is connected to the key top, a membrane sheet that includes a contact that opens and closes in accordance with the elevating operation of the key top, a back plate, and a housing that holds the rotatable shaft of the link member to the back plate, the method including: pushing the link member such that the sliding shafts moves away from the back plate.

According to another embodiment, there is provided a key switch device including a key top; a link member that guides an elevating operation of the key top, the link member including a rotatable shaft and a sliding shaft that is connected to the key top; a membrane sheet that includes a contact that opens and closes a contact in accordance with the elevating operation of the key top; a back plate; and a housing that holds the rotatable shaft of the link member to the back plate, wherein the back plate is provided with a through hole at a position corresponding to the link member near the rotatable shaft.

BRIEF DESCRIPTION OF THE DRAWINGS

Other objects, features and advantages of the present invention will become more apparent from the following detailed description when read in conjunction with the accompanying drawings.

DESCRIPTION OF EMBODIMENTS

Figure 1:
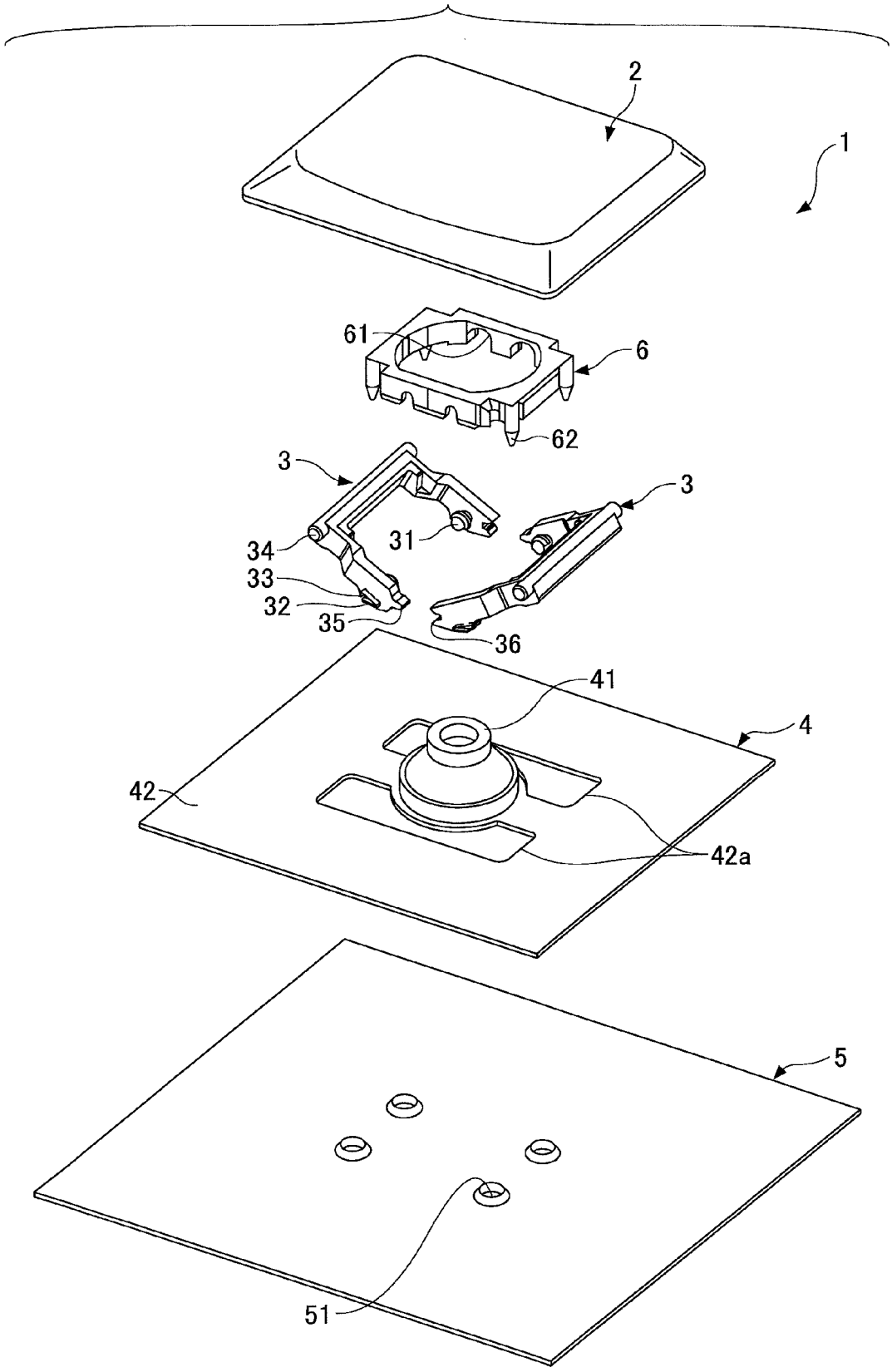
FIG. 1 is a schematic exploded view illustrating an example of a key switch device of a first embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

First Embodiment

Figure 3:
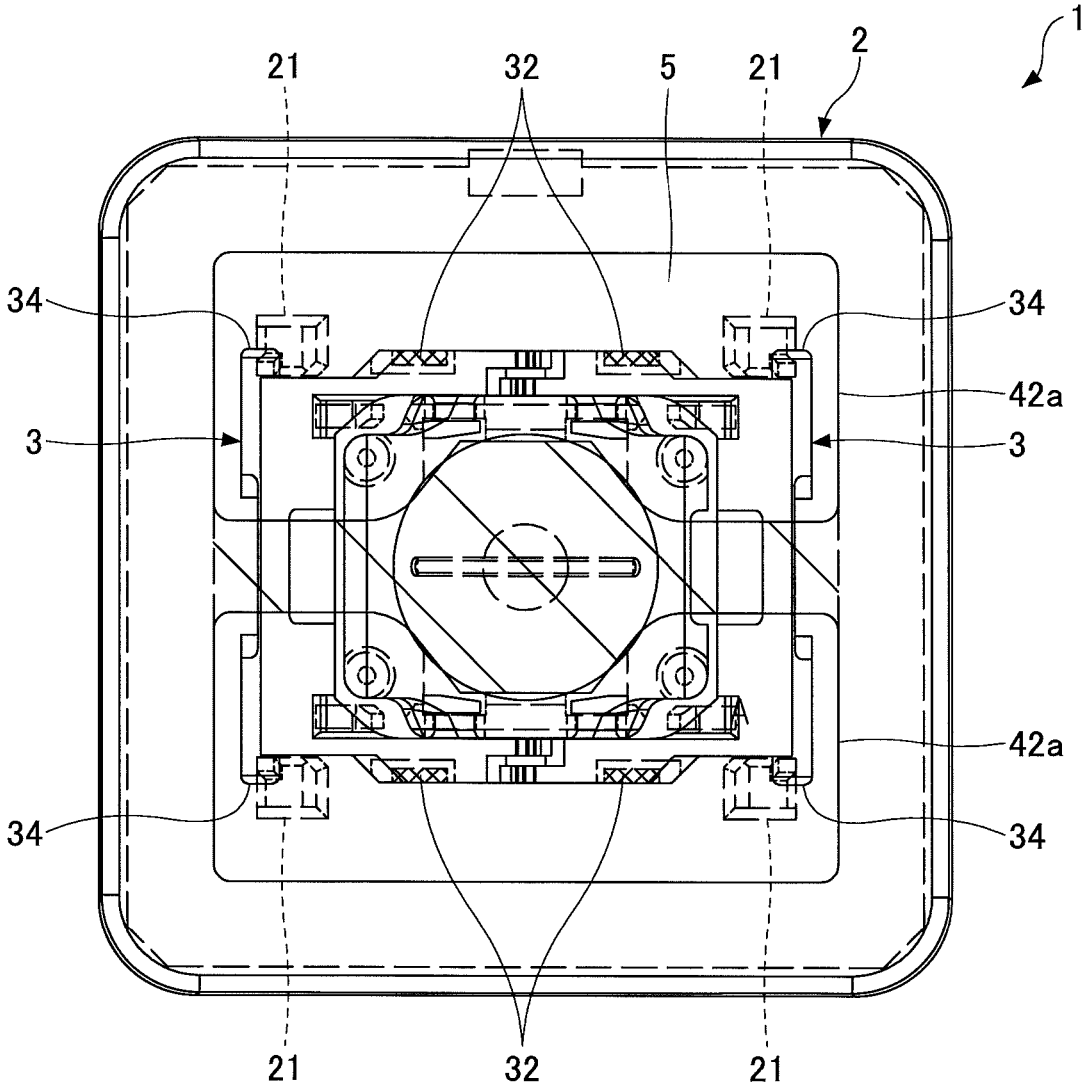
FIG. 3 is a schematic transparent plan view illustrating an example of the key switch device of the first embodiment seen from a front surface side.
Figure 4:
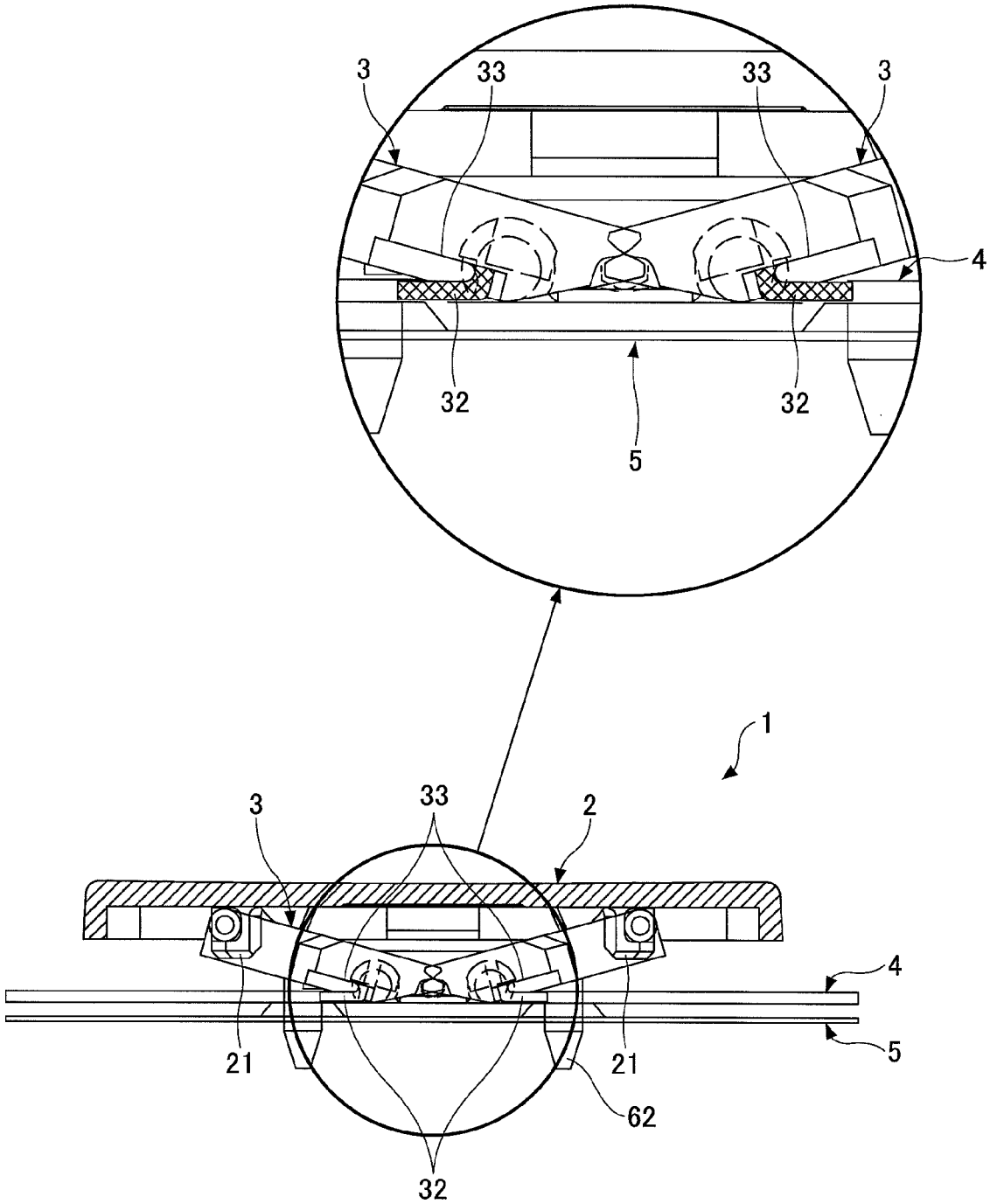
FIG. 4 is a schematic cross-sectional view illustrating an example of the key switch device of the first embodiment when a key top is attached.

FIG. 1 is a schematic exploded view illustrating an example of a key switch device 1 of the first embodiment. FIG. 3 is a schematic transparent plan view illustrating an example of the key switch device 1 of the first embodiment seen from a front surface side. FIG. 4 is a schematic cross-sectional view illustrating an example of the key switch device 1 of the first embodiment. In FIG. 4, an enlarged schematic cross-sectional view of a part surrounded by a circle is also illustrated.

With reference to FIG. 1, the key switch device 1 includes a key top 2, a pair of gear links 3 (an example of a link member), a membrane sheet 4, a back plate 5, and a housing 6.

It is defined that an upper side of the key top 2 in FIG. 1, at which a finger touches, is referred to as a "front surface side" and a lower side of the key top 2 in FIG. 1 facing the back plate 5 via the membrane sheet 4 is referred to as a "back surface side".

The gear links 3 are connected to the key top 2 and guide an elevating operation of the key top 2 while interlocking with the key top 2. Each of the gear links 3 includes rotatable pins 31 (an example of a rotatable shaft) and a pair of flat springs 32 (an example of a pushing unit). The membrane sheet 4 includes contacts each of which corresponds to any of the key top 2. Each contact opens and closes in accordance with the elevating operation of the respective key top 2. The back plate 5 is stacked on the membrane sheet 4 at the back surface side of the membrane sheet 4. The housing 6 mounts and holds the rotatable pins 31 of the gear links 3 to the back plate 5. The pair of flat springs 32 push the respective gear link 3 from the back surface side by an urging force (pushing force) when the gear link 3 is rotated closer to the back plate 5 while having the rotatable pin 31 as a rotatable shaft.

The key top 2 is a saucer-like member having a rectangular shape when seen in a plan view, for example.

The housing 6 is a frame member having a rectangular shape when seen in a plan view, for example. The housing 6 includes two pairs of bearing portions 61 and four leg portions 62. The two pairs of bearing portions 61 are provided at the back surface side of the housing 6 and rotatably support the rotatable pins 31 of the gear links 3, respectively. The leg portions 62 are provided to protrude from four corners of the housing 6 to align and fix the housing 6 to the back plate 5. The gear links 3 have the same shape and the same size. The key top 2, the housing 6 and the gear link 3 may be formed by a resin material such as acrylonitrile butadiene styrene resin (ABS) or the like, for example.

Figure 2:
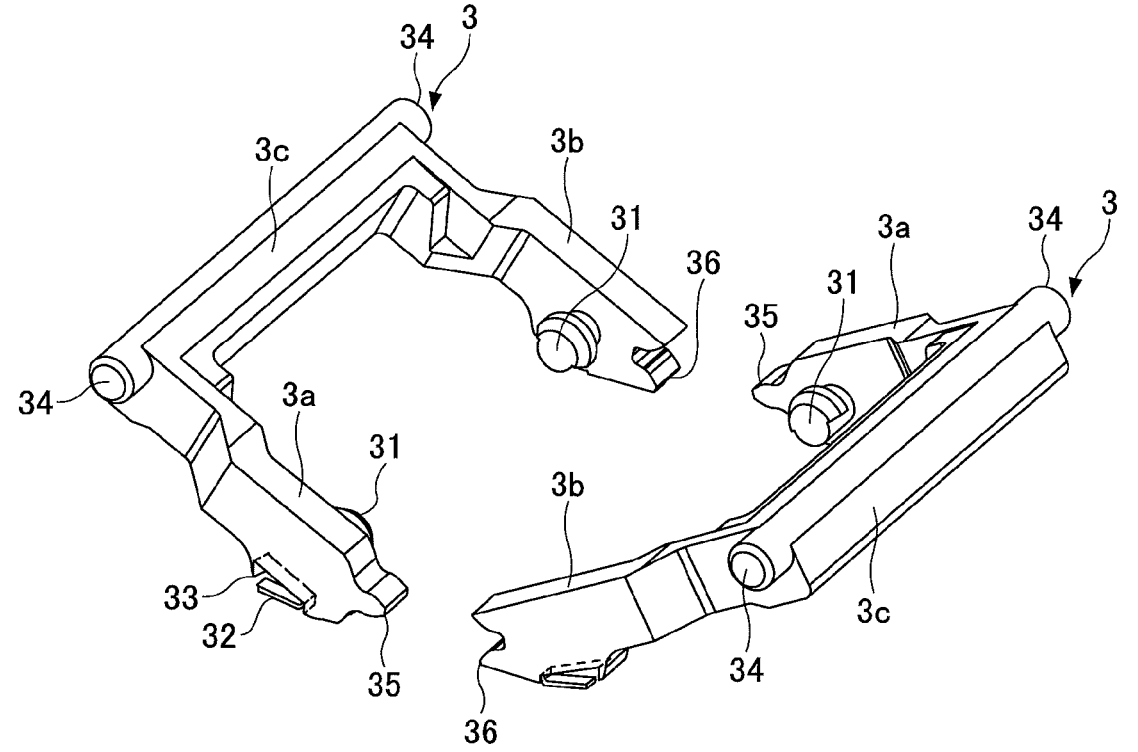
FIG. 2 is a schematic perspective view illustrating an example of gear links of the key switch device of the first embodiment.

FIG. 2 is a schematic perspective view illustrating an example of the gear links 3.

The gear link 3 has a "U" shaped frame including a first arm portion 3*a*, a second arm portion 3*b* and a connection portion 3*c* connecting the first arm portion 3*a* and the second arm portion 3*b*. Here, a space formed between the first arm portion 3*a* and the second arm portion 3*b* is referred to as an "opening".

The gear link 3 further includes the rotatable pins 31, the flat springs 32, a sliding pin 34 (an example of a sliding shaft), and a first teeth portion 35 and a second teeth portion 36. The rotatable pins 31 protrude from an inner side of the "U" shaped frame of the gear link 3.

The flat springs 32, each having a flat plate shape, are respectively provided at the first arm portion 3*a* and the second arm portion 3*b*. One end of each of the flat springs 32 is connected to the first arm portion 3*a* or the second arm portion 3*b* at a position outside of the rotation center of the rotatable pin 31 in a radial direction to extend in a direction away from the respective rotatable pin 31 while being apart from the respective first arm portion 3*a* or the second arm portion 3*b*. The flat springs 32 may be integrally formed with the gear link 3 or alternatively, may be separately formed by a metal material, or other elastic material, and attached to the gear link 3.

Further, the first arm portion 3*a* and the second arm portion 3*b* are provided with concave portions 33. The flat spring 32 is housed to the concave portion 33 when the flat spring 32 is deflected as the gear link 3 contacts the back plate 5.

The sliding pin 34, extending along the connection portion 3*c*, is provided at the connection portion 3*c*. The sliding pin 34 outwardly protrudes from the connection portion 3*c*.

The connection portion 3*c* is configured to extend in a rotation axis direction of the rotatable pin 31. Thus, the sliding pin 34 is also configured to extend in the rotation axis direction of the rotatable pin 31.

The first teeth portion 35 includes a single tooth and is provided at a front end of the first arm portion 3*a*. The second teeth portion 36 includes two teeth and is provided at a front end of the second arm portion 3*b*.

When the openings of two gear links 3 are faced toward each other, the first teeth portion 35 of one of the gear links 3 engages the second teeth portion 36 of the other of the gear links 3, and the second teeth portion 36 of one of the gear links 3 engages the first teeth portion 35 of the other of the gear links 3.

With reference to FIG. 3 and FIG. 4, the key top 2 is provided with two pairs of hooks 21 at its back surface side. Each of the hooks 21 has a "U" shape in a cross-sectional view as illustrated in FIG. 4. The gear links 3 are slidably supported by the key top 2 when the sliding pins 34 are pressed and fitted in the hooks 21, respectively.

Referring back to FIG. 1, the membrane sheet 4 includes a partially conical rubber dome 41 and a substantially flat membrane sheet 42. The rubber dome 41 is provided at a front surface of the membrane sheet 42 such that the center of the rubber dome 41 matches the center of the key top 2. The membrane sheet 42 includes a front surface side sheet, a back surface side sheet and a spacer sheet provided between the front surface side sheet and the back surface side sheet. The membrane sheet 42 further includes a pair of contacts (not illustrated) provided in the front surface side sheet and the back surface side sheet, respectively, at a position corresponding to the center of the rubber dome 41. The contacts provided in the front surface side sheet and the back surface side sheet contact with each other when the key top 2 is pushed. The membrane sheet 42 is provided with a pair of opening portions 42*a* having symmetrical shapes with respect to the rubber dome 41.

The membrane sheet 42 may be made of a resin material such as polyethlene terephthalate (PET) or the like, for example. The rubber dome 41 may be made of an elastic resin material such as a rubber or the like.

The back plate 5 is stacked on the back surface side of the membrane sheet 42. The back plate 5 of the first embodiment is a support plate made of a metal plate such as a sheet metal, stainless steel or the like. The back plate 5 is provided with hole portions 51 respectively corresponding to the leg portions 62 of the housing 6. The hole portions 51 are formed by punching the back plate 52 from its back surface side. Each of the hole portions 51 has a partially conical shape protruding toward the front surface side to be tapered in the front surface side.

The key switch device 1 of the first embodiment is manufactured as follows.

With reference to FIG. 1 and FIG. 4, the back plate 5, the membrane sheet 4 and the gear links 3 are stacked in this order. At this time, the flat springs 32 pass through the opening portions 42*a* of the membrane sheet 4 and contact the front surface side of the back plate 5, as illustrated in FIG. 4.

Thereafter, the housing 6 is stacked on the gear links 3 from the front surface side. At this time, the rotatable pins 31 are inserted in the bearing portions 61, respectively, and the leg portions 62 are inserted in the hole portions 51, respectively. With this configuration, positions of the housing 6, the gear links 3, the membrane sheet 4 and the back plate 5 are determined. Then, the back surface side of the housing 6 is bonded to the front surface side of the back plate 5 by adhesive.

An end of each of the leg portions 62 that protrudes toward the back surface side is deformed by heat caulking and the ends of the deformed leg portions 62 are housed and fixed in the hole portions 51, respectively, for example. This operation of heat caulking may be performed at an appropriate timing after the key top 2 is attached. When the ends of the leg portions 62 are deformed by heat caulking, the back surface side of the housing 6 may not be bonded to the front surface side of the back plate 5 by the adhesive.

Figure 5:
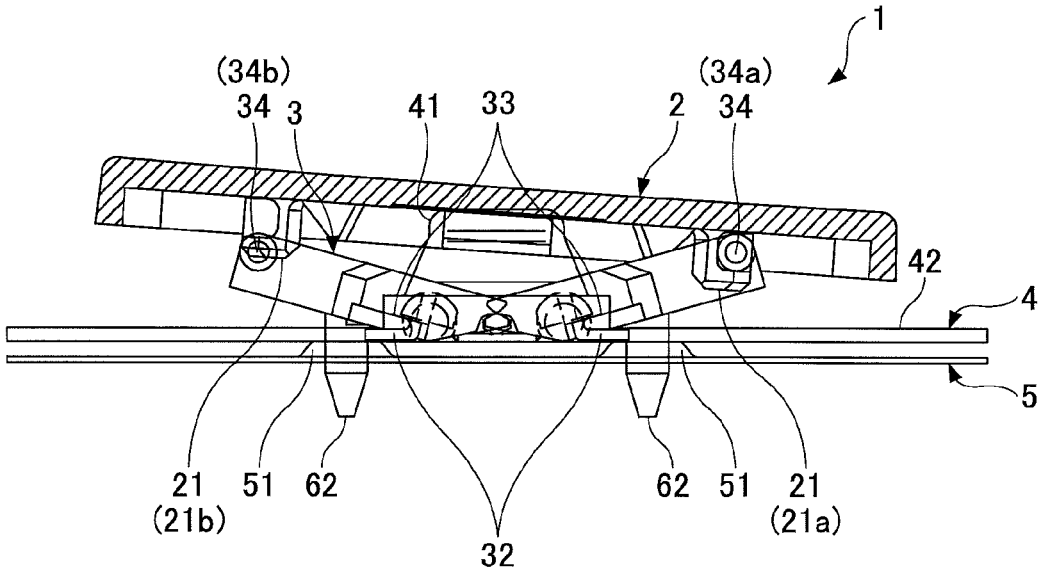
FIG. 5 is a schematic cross-sectional view illustrating an example of the key switch device of the first embodiment when the key top is about to be attached in a manufacturing step.

FIG. 5 is a schematic cross-sectional view illustrating an example of the key switch device 1 of the first embodiment when the key top 2 is about to be attached.

FIG. 5 illustrates a state in which one side of the hooks 21 (21*a*, at the right side) of the key top 2 is about to be pressed and fitted in the sliding pin 34 (34*a*) of one of the gear links 3. After the sliding pin 34*a* fits the hooks 21*a*, the other side of the hooks 21 (21*b*, at the left side) of the key top 2 is pressed and fitted in the sliding pin 34 (34*b*) of the other of the gear links 3.

As illustrated in FIG. 2, the flat springs 32 are configured to apart from the first arm portion 3*a* and the second arm portion 3*b* of the respective gear link 3 as extending outward in the radial direction of the respective rotatable pins 31. Thus, as illustrated in FIG. 5, the gear link 3 presses the front side surface of the back plate 5 by the urging force of the respective flat springs 32. Therefore, even before attaching the key top 2 to the gear links 3, the gear links 3 are pushed in a direction away from the back plate 5 by counteraction of the flat springs 32 while being rotated around the respective rotatable pins 31. Thus, the gear links 3 retain a standing state at which the gear links 3 stand in a "V" shape.

The height of the sliding pin 34 from the front surface of the membrane sheet 4 at the standing state, before the key top 2 is attached as illustrated in FIG. 5, is set to be equal to or slightly lower than the height of the sliding pin 34 from the front surface of the membrane sheet 4 after the key top 2 is attached as illustrated in FIG. 4. A total of urging forces of the two pairs of the flat springs 32 is set to be smaller than an elastic force of the rubber dome 41.

As the standing state is retained as described above, when pressing and fitting the hook 21*b* in the sliding pin 34*b*, a deflecting amount of the rubber dome 41 can be minimized.

As described above, according to the first embodiment, a deflecting amount of the rubber dome 41 can be minimized when attaching the key top 2 to the gear links 3 by pressing and fitting the hooks 21 of the key top 2 to the respective sliding pins 34 of the gear links 3. Thus, an operator can easily perform an alignment or a pressing and fitting operation of the key top 2 with respect to the gear links 3 without a specific skill. Further, the unusual feeling of the rubber dome 41 or the like can also be prevented.

Further, the flat springs 32 are used when manufacturing the key switch device 1 of the first embodiment.

A keyboard of the embodiment includes a plurality of the key switch devices 1 aligned in a predetermined pattern that is the same as known keyboards, thus, the keyboard of the embodiment is not illustrated in the drawings.

Figure 6:
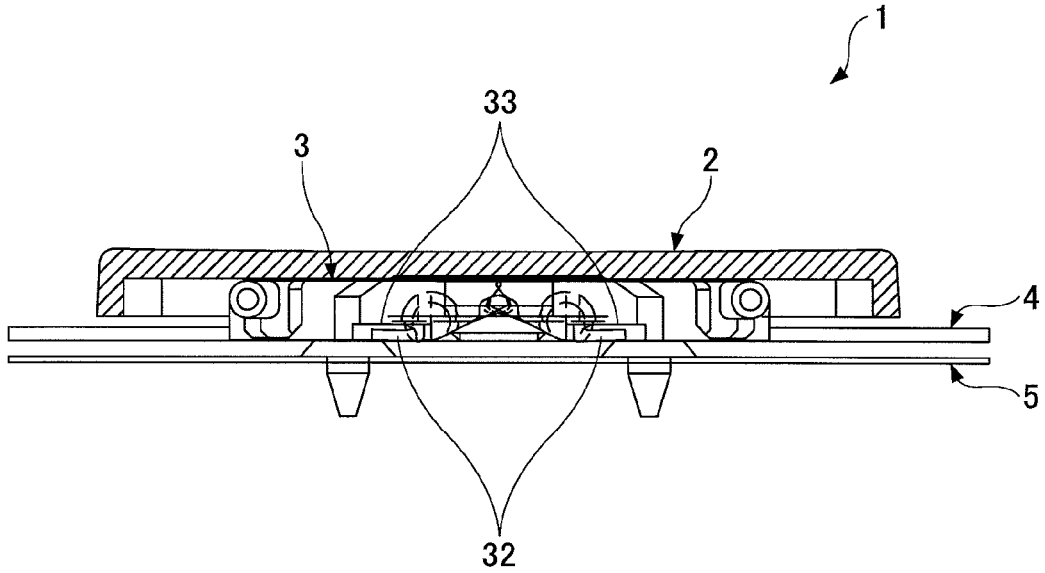
FIG. 6 is a schematic cross-sectional view illustrating an example of the key switch device of the first embodiment at a stroke end in a keying operation.

A keying operation is explained with reference to FIG. 4 and FIG. 6. Before the keying operation is performed (when the key top 2 is not pressed), which is an initial state, the key top 2 and the sliding pins 34 of the gear links 3 are retained at the standing position by the elastic force of the rubber dome 41, as illustrated in FIG. 4. When the keying operation is performed and the key top 2 is pressed against the elastic force of the rubber dome 41 and the urging force of the flat springs 32, the key top 2 is moved to a stroke end, as illustrated in FIG. 6.

The urging force of the flat springs 32 become stronger as the key top 2 is pressed deeper. Thus, a keying sound that is generated when the hook 21 or the like provided at the back surface of the key top 2 contacts with the back plate 5 via the opening portion 42*a* of the membrane sheet 42, can be minimized.

Second Embodiment

Figure 7:
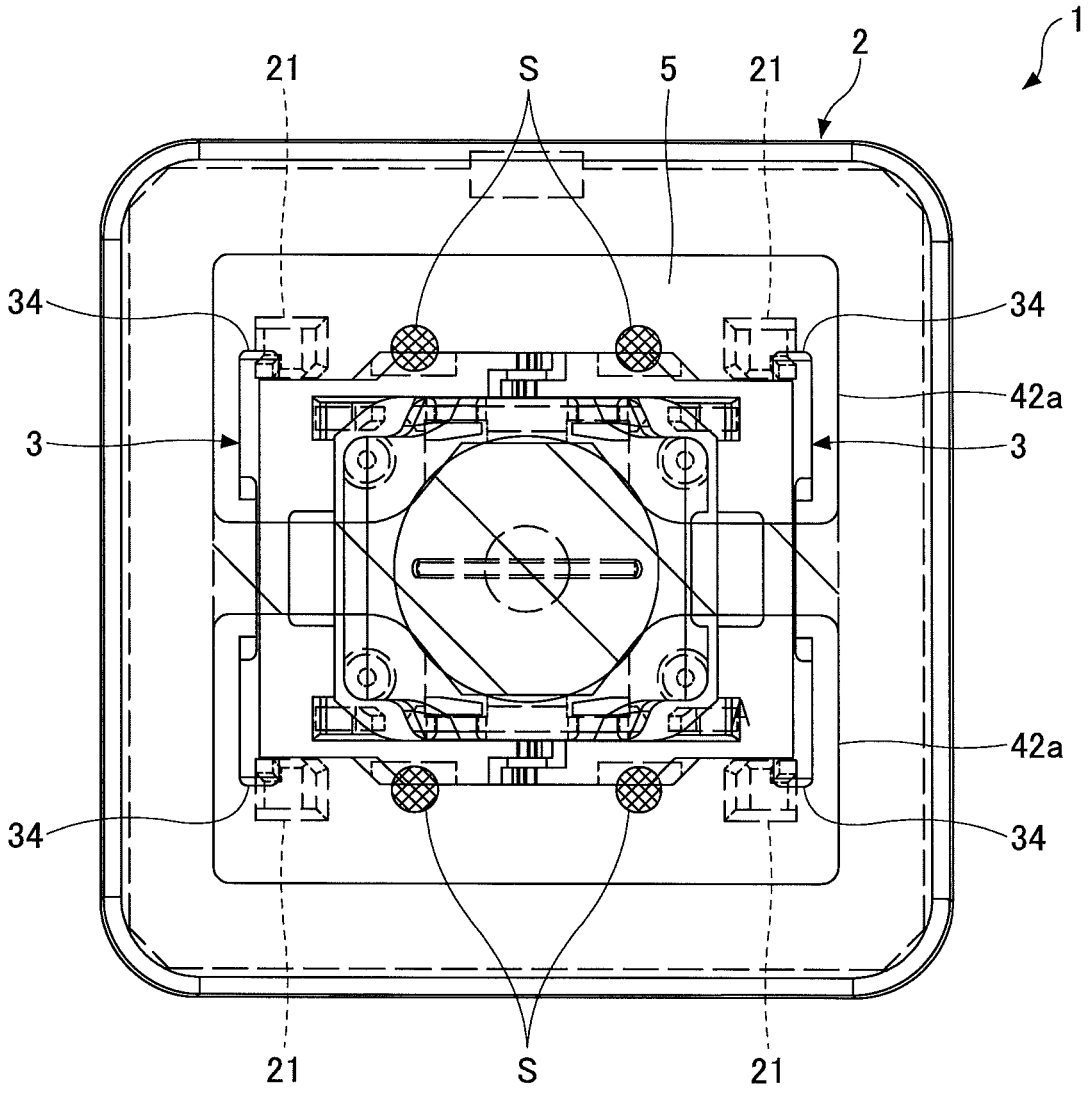
FIG. 7 is a schematic transparent plan view illustrating an example of the key switch device of a second embodiment seen from a front surface side.
Figure 8:
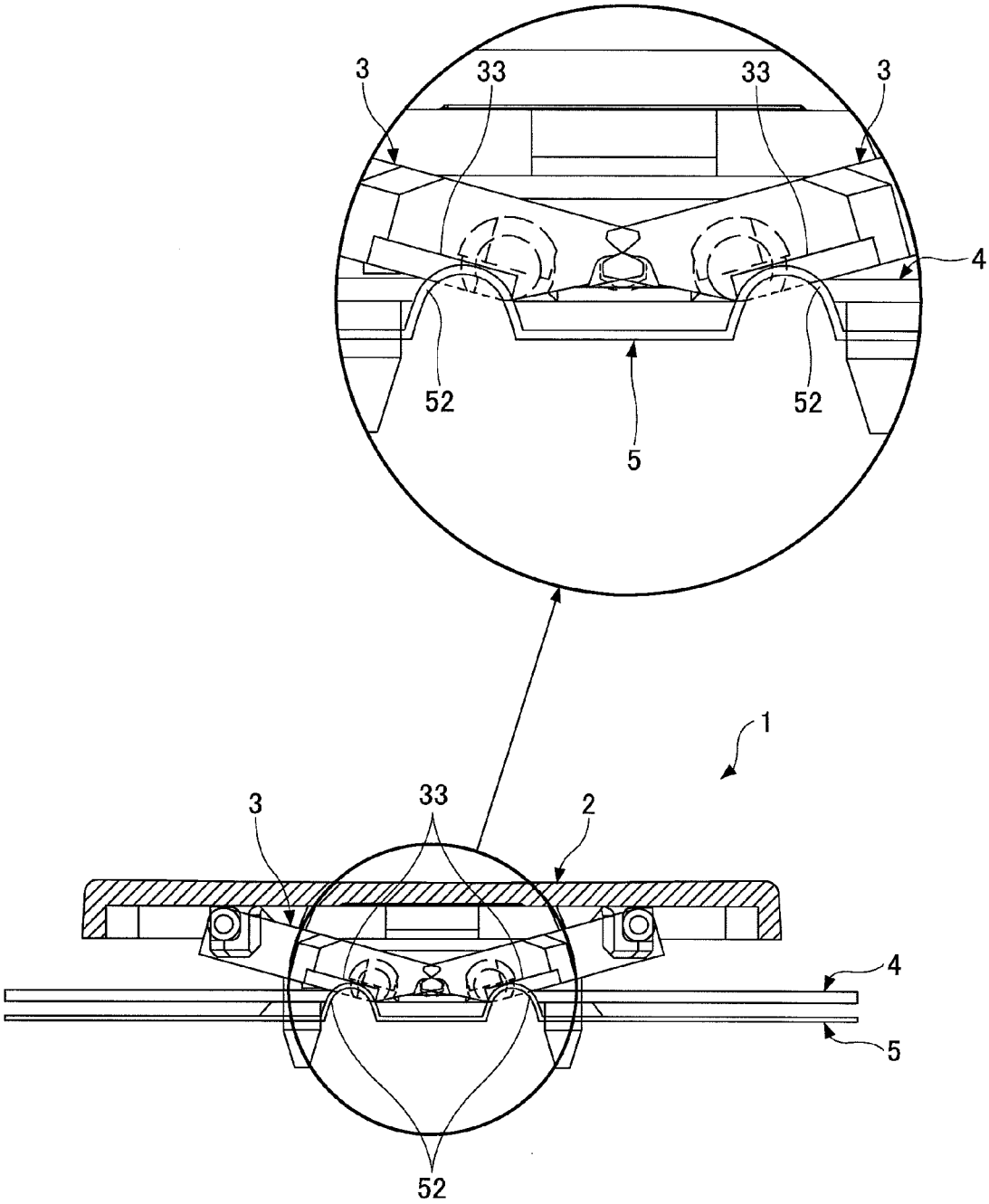
FIG. 8 is a schematic cross-sectional view illustrating an example of the key switch device of the second embodiment when a key top is attached.
Figure 9:
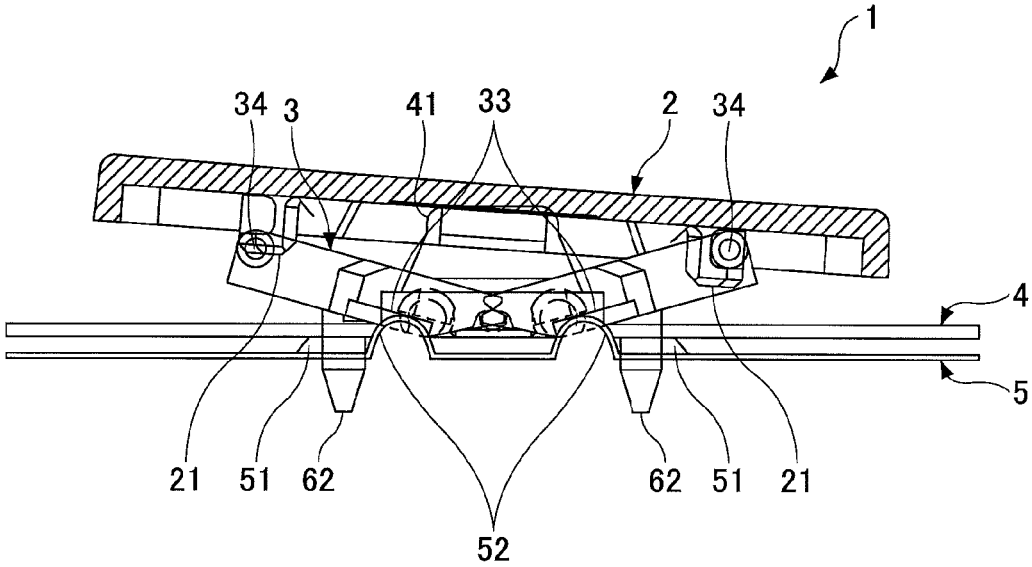
FIG. 9 is a schematic cross-sectional view illustrating an example of the key switch device of the second embodiment when the key top is about to be attached in a manufacturing step.
Figure 10:
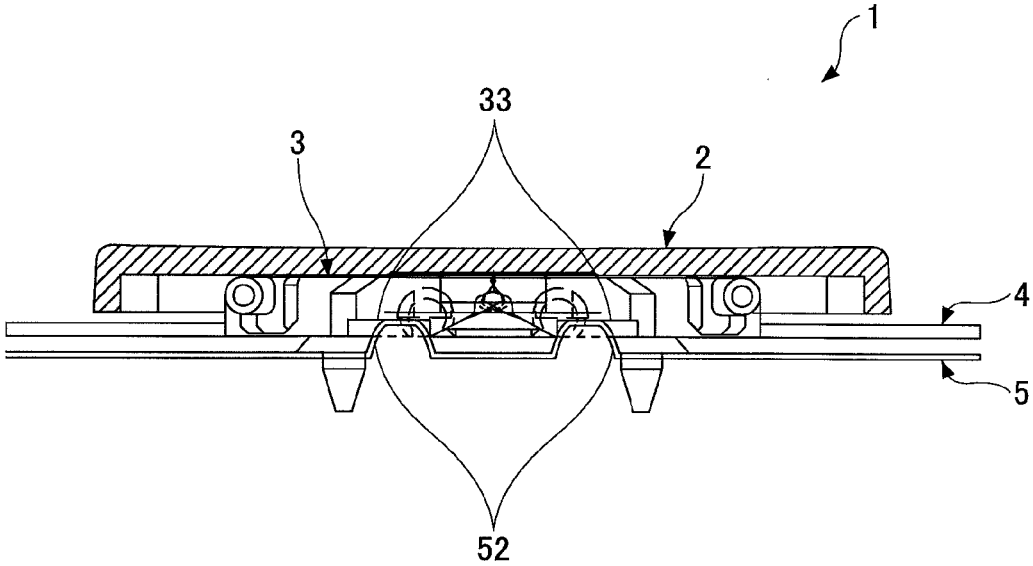
FIG. 10 is a schematic cross-sectional view illustrating an example of the key switch device of the second embodiment at a stroke end in a keying operation.

FIG. 7 is a schematic transparent plan view illustrating an example of the key switch device 1 of the second embodiment seen from the front surface side. FIG. 8 is a schematic cross-sectional view illustrating an example of the key switch device 1 of the second embodiment when the key top 2 is attached. FIG. 9 is a schematic cross-sectional view illustrating an example of the key switch device 1 of the second embodiment when the key top 2 is about to be attached. FIG. 10 is a schematic cross-sectional view illustrating an example of the key switch device 1 of the second embodiment at the stroke end in a keying operation.

In the second embodiment, the back plate 5 is a thin film sheet made of a resin material such as polyethlene terephthalate (PET) or the like. The thin film sheet is provided with protruding portions 52 (an example of a protrusion).

In this embodiment, the protruding portions 52 are formed in the back plate 5 at positions corresponding to areas "S" (see FIG. 7). The areas "S" correspond to portions of the key top 2 at which the urging forces of the flat springs 32 are applied in the first embodiment. The protruding portions 52 protruded toward the front surface side are formed by performing embossing on the thin film sheet composing the back plate 5.

These protruding portions 52 of the second embodiment function as a pushing unit. The protruding portions 52 push the arm portions 3*a* 3*b* of the gear links 3 while contacting the concave portions 33 of the gear links 3, by an elasticity of the thin film sheet. Specifically, the protruding portions 52 push the respective gear link 3 from the back surface side by an urging force stored in the protruding portions 52 when the gear links 3 are rotated closer to the back plate 5 around the rotatable pins 31, respectively.

As described above, as the protruding portions 52 of the back plate 5 function as a pushing unit, the urging force by the protruding portions 52 push bottom surfaces of the concave portions 33 of the gear links 3 from the back surface side, respectively. Thus, as illustrated in FIG. 9, similar to the first embodiment, even before attaching the key top 2 to the gear links 3, the gear links 3 are pushed in a direction away from the back plate 5 while being rotated around the respective rotatable pins 31. Therefore, the gear links 3 retain a standing state at which the gear links 3 stand in a "V" shape.

As this standing state is retained, as illustrated in FIG. 9, when attaching the key top 2 to the gear links 3 by pressing and fitting the hooks 21 of the key top 2 to the respective sliding pins 34 of the gear links 3, a deflecting amount of the rubber dome 41 can be decreased.

As described above, according to the second embodiment, similar to the first embodiment, the deflecting amount of the rubber dome 41 can be decreased when attaching the key top 2 to the gear links 3. Thus, an operator can easily perform an alignment or a pressing and fitting operation of the key top 2 with respect to the gear links 3 without a specific skill. Further, the unusual feeling of the rubber dome 41 or the like can also be prevented.

Further, the key switch device 1 of the second embodiment can be manufactured by composing the back plate 5 by the thin film sheet provided with the protruding portions 52.

Similar to the first embodiment, a keyboard of the second embodiment includes the key switch devices 1 aligned in a predetermined pattern that is the same as known keyboards, thus, the keyboard of the embodiment is not illustrated in the drawings.

A keying operation is explained with reference to FIG. 8 and FIG. 10. When the key switch device 1 is not pressed, the key top 2 and the sliding pins 34 of the gear links 3 are retained at a top dead center (the standing position) by the elastic force of the rubber dome 41, as illustrated in FIG. 8. When the key top 2 is pressed against the elastic force of the rubber dome 41 and the urging force of the protruding portions 52, the key top 2 is moved to a bottom dead center, as illustrated in FIG. 10.

In this embodiment, the urging force of the protruding portions 52 become stronger as the key top 2 is pressed deeper. Thus, similar to the first embodiment, a keying sound that is generated when the hook 21 or the like provided at the back surface of the key top 2 contacts with the back plate 5 via the opening portions 42*a* of the membrane sheet 42, can be minimized.

Third Embodiment

The protruding portions may be formed in the membrane sheet 42 instead of being formed in the back plate 5 as explained above in the second embodiment.

Figure 11:
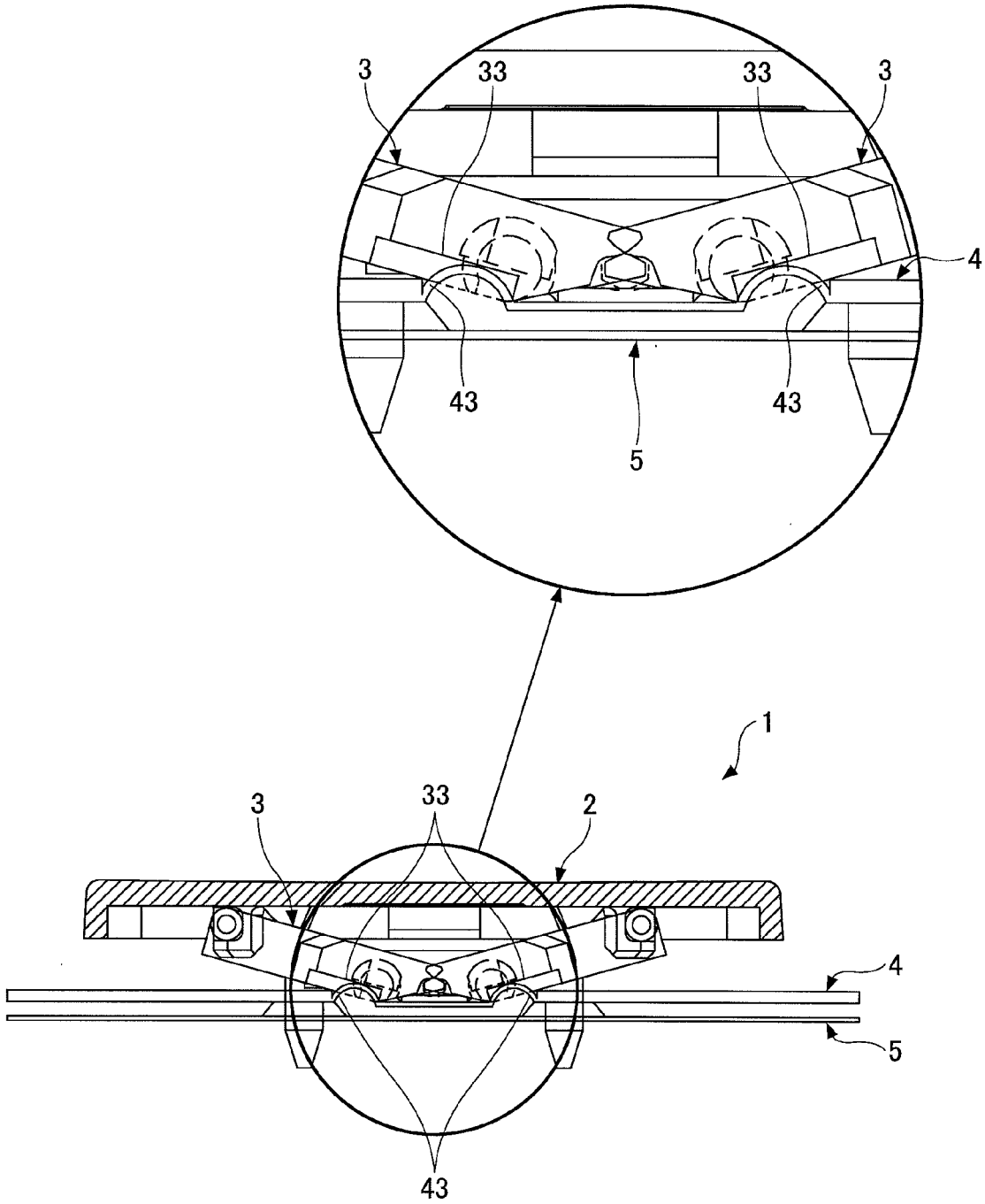
FIG. 11 is a schematic cross-sectional view illustrating an example of the key switch device of a third embodiment when a key top is attached.

FIG. 11 is a schematic cross-sectional view illustrating an example of the key switch device 1 of the third embodiment when the key top 2 is attached. In this embodiment, protruding portions 43 are formed in the back surface side sheet of the membrane sheet 42. In this case, the opening portions 42*a* are formed only in the front surface side sheet and the spacer sheet of the membrane sheet 42.

According to the third embodiment, the same advantage can be obtained as the second embodiment.

Fourth Embodiment

Figure 12:
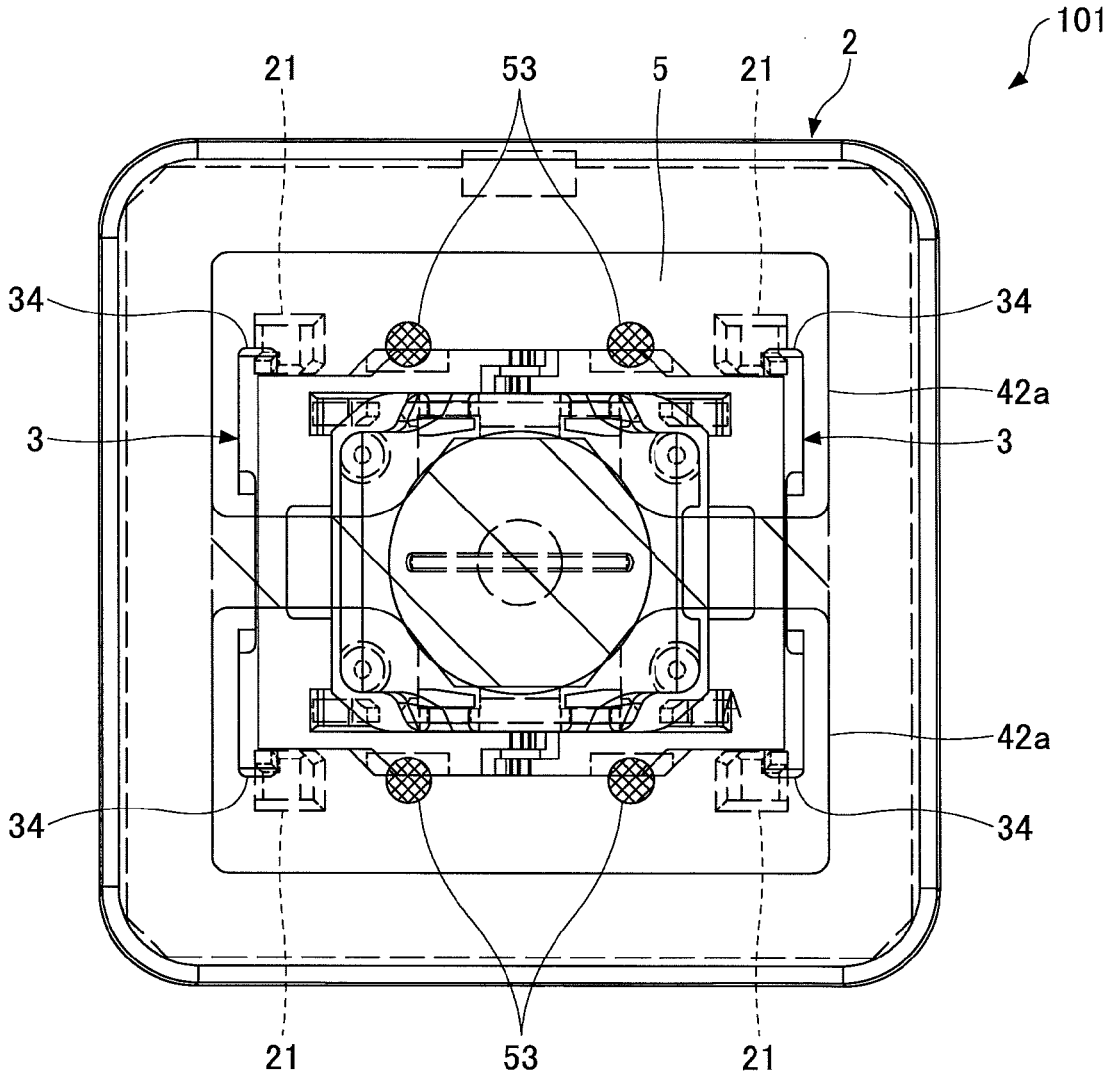
FIG. 12 is a schematic transparent plan view illustrating an example of the key switch device of a fourth embodiment seen from a front surface side.
Figure 13:
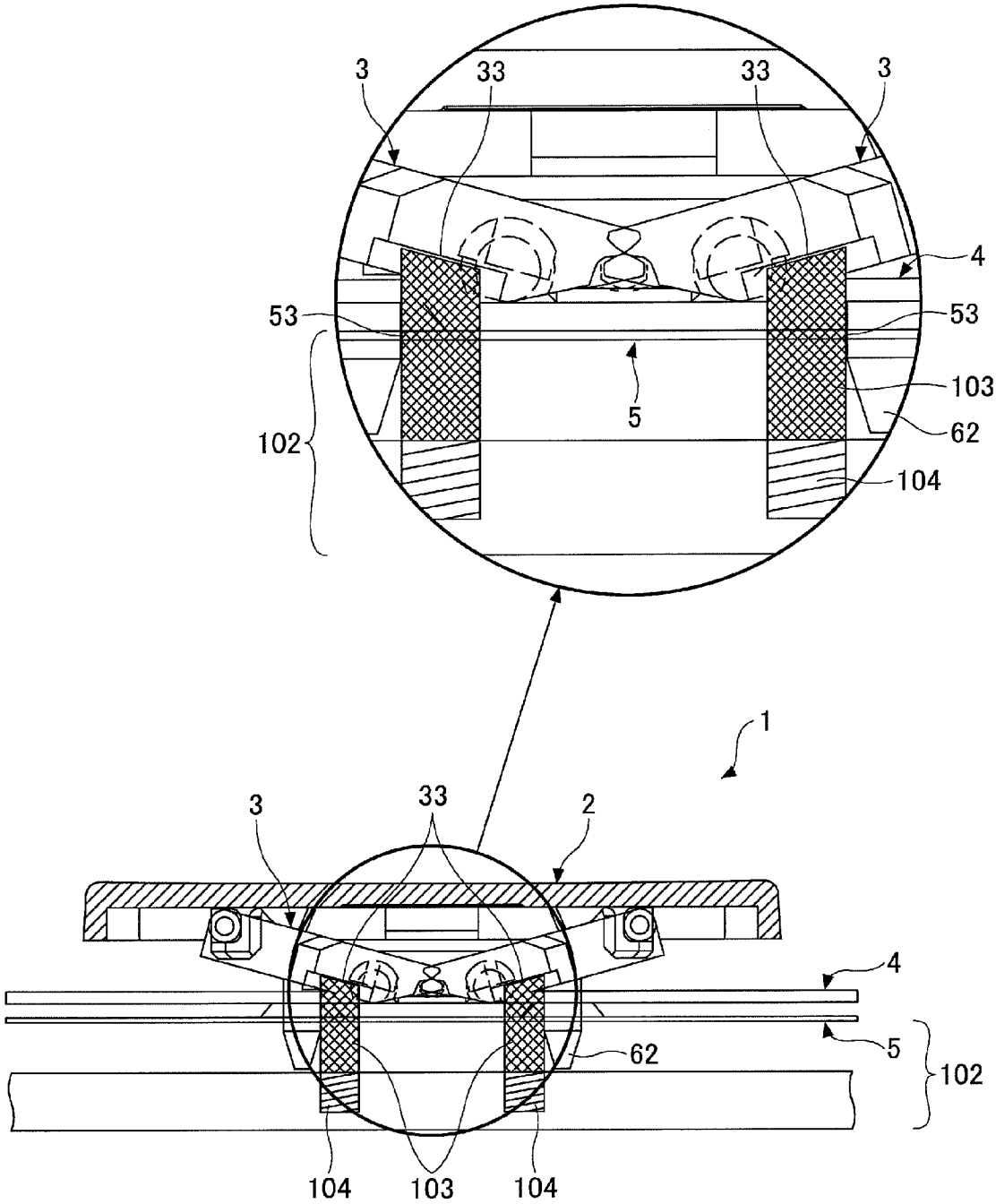
FIG. 13 is a schematic cross-sectional view illustrating an example of the key switch device of the fourth embodiment when a key top is attached.
Figure 14:
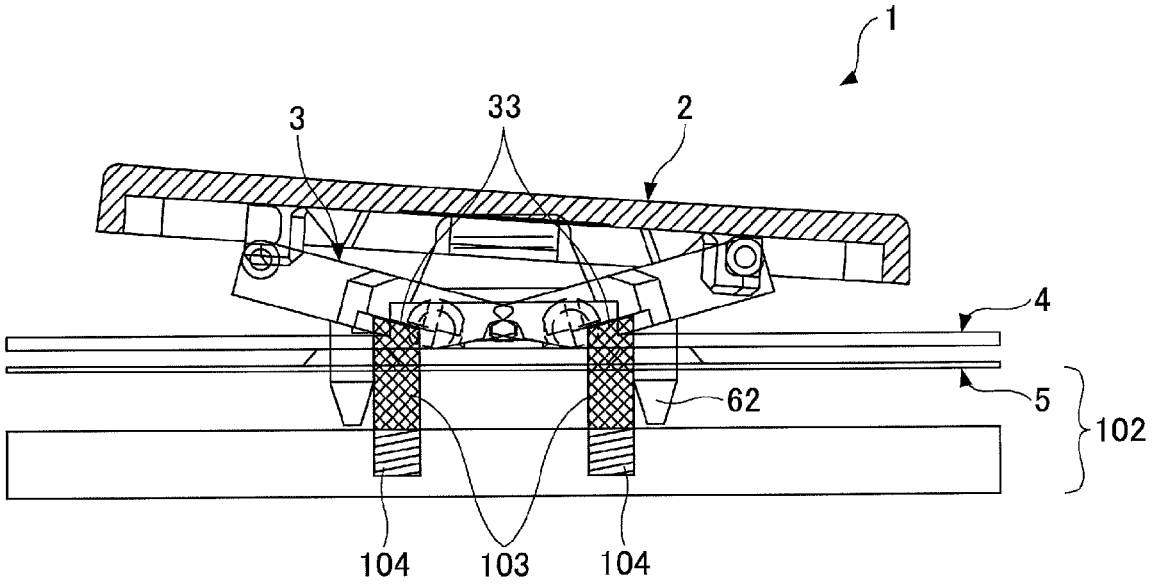
FIG. 14 is a schematic cross-sectional view illustrating an example of the key switch device of the fourth embodiment when the key top is about to be attached in a manufacturing step.

FIG. 12 is a schematic transparent plan view illustrating an example of a key switch device 101 of a fourth embodiment seen from the front surface side. FIG. 13 is a schematic cross-sectional view illustrating an example of the key switch device 101 of the fourth embodiment when the key top 2 is attached. FIG. 14 is a schematic cross-sectional view illustrating an example of the key switch device 101 of the fourth embodiment when the key top 2 is about to be attached in a manufacturing step.

In this embodiment, the key switch device 101 is different from the key switch device 1 of the first to third embodiments in that the key switch device 101 does not include the pushing unit such as the flat springs 32, the protruding portions 52 or the protruding portions 43. Instead, according to the fourth embodiment, the key switch device 101 is manufactured using a jig provided with the pushing unit.

As illustrated in FIG. 12, the back plate 5 of the fourth embodiment is provided with two pairs of through holes 53, instead of providing the pushing unit that is included in the key switch device 1 of the first to third embodiments. Specifically, the through holes 53 are provided at positions corresponding to the pushing unit of the first to third embodiments, in other words, at positions corresponding to the concave portions 33.

As illustrated in FIG. 13, a jig 102 that is used when manufacturing the key switch device 101 is provided with two pairs of cylindrical pins 103 and springs 104 that push the pins 103 from the back surface side of the key switch device 101. The pins 103 contact the respective concave portions 33. A surface of each of the pins 103 that contacts the concave portion 33 is configured to be tapered where the distance between the surface and the back plate 5 becomes longer as further apart from the respective rotatable pin 31. The gear links 3 can retain a desired standing position when the urging force is applied by the jig 102 from the back surface side.

As described above, the pins 103 pushed by the springs 104 of the jigs 102 push the bottom surfaces of the concave portions 33 of the gear links 3 from the back surface side, respectively. Thus, as illustrated in FIG. 14, similar to the first to third embodiments, even before attaching the key top 2 to the gear links 3, the gear links 3 are pushed in a direction away from the back plate 5 while being rotated around the respective rotatable pins 31. Therefore, the pair of gear links 3 retain the standing state, similar to the first to third embodiments.

As this standing state is retained, as illustrated in FIG. 14, when attaching the key top 2 to the gear links 3 by pressing and fitting the hooks 21 of the key top 2 to the respective sliding pins 34 of the gear links 3, a deflecting amount of the rubber dome 41 can be decreased.

As described above, according to the fourth embodiment, similar to the first to third embodiments, the deflecting amount of the rubber dome 41 can be decreased when attaching the key top 2 to the gear links 3. Thus, an operator can easily perform an alignment or a pressing and fitting operation of the key top 2 with respect to the gear links 3 without a specific skill. Further, the unusual feeling of the rubber dome 41 or the like can also be prevented.

Further, the key switch device 101 of the fourth embodiment is manufactured by providing the through holes 53 to the back plate 5 while using the jig 102 provided with the pins 103 that penetrate the through holes 53, respectively, and springs 104 that push the pins 103, respectively, from the back surface side.

Similar to the first embodiment, a keyboard of the embodiment includes a plurality of the key switch devices 101 aligned in a predetermined pattern that is the same as known keyboards, thus, the keyboard of the embodiment is not illustrated in the drawings.

In the fourth embodiment, the jig 102 including the pushing unit is removed from the final product. When the key switch device 101 is not pressed, the key top 2 and the sliding pins 34 of the gear links 3 are retained at a top dead center by the elastic force of the rubber dome 41. Then, when the keying operation is performed and the key top 2 is pressed against the elastic force of the rubber dome 41, the key top 2 is moved to a bottom dead center.

According to the embodiments, even before attaching the key top, the link members can be retained at the standing position. Therefore, positions of the key top and the link members can be easily matched when attaching the key top to the sliding shafts of the link members. Therefore, according to the embodiments, manufacturing steps of the key switch device can be reduced and the cost can also be reduced.

Further, a keying sound can be reduced because contact of the key top, mainly hooks or an outer end portion thereof, with the back plate at a stroke end in a keying operation can be suppressed as an urging force of the pushing unit is added to an elastic force of the rubber dome generated when the rubber dome is compressed.

The present embodiments relate to a key switch device for inputting data by a keying operation, a keyboard, and a method of manufacturing the key switch device. As problems such as the unusual feeling can be suppressed without increasing manufacturing steps or increasing a burden to an operator according to the embodiments, the embodiments can be applied to various electronic devices.

Although a preferred embodiment of the key switch device, a keyboard, and a method of manufacturing the key switch device has been specifically illustrated and described, it is to be understood that minor modifications may be made therein without departing from the spirit and scope of the invention as defined by the claims.

The present invention is not limited to the specifically disclosed embodiments, and numerous variations and modifications and modifications may be made without departing from the spirit and scope of the present invention.

The present application is based on and claims the benefit of priority of Japanese Priority Application No. 2012-253570 filed on Nov. 19, 2012, the entire contents of which are hereby incorporated by reference.

What is claimed is:

1. A key switch device comprising:
a key top;
a link member that guides an elevating operation of the key top while being interlocked with the key top,
the link member including
a rotatable shaft and
a sliding shaft that is connected to the key top;
a membrane sheet that includes a contact that opens and closes in accordance with the elevating operation of the key top;
a back plate;
a housing that holds the rotatable shaft of the link member to the back plate; and
a pushing unit that directly pushes the link member such that the sliding shaft moves away from the back plate,
wherein the pushing unit is either one of:
a flat spring provided on the link member that pushes a surface of the back plate,
a protrusion formed at a surface of the back plate, the back plate being a thin film sheet, or
a protrusion formed at the membrane sheet.

2. The key switch device according to claim 1,
wherein the pushing unit is the protrusion formed at the membrane sheet and
wherein the membrane sheet includes a back surface side sheet, a spacer sheet and a front surface side sheet stacked in this order, and
wherein the protrusion is formed at a surface of the back surface side sheet.

3. The key switch device according to claim 1,
wherein the key top is provided with a hook, and
wherein the link member is slidably supported by the key top when the sliding shaft of the link member is fitted in the hook.

4. The key switch device according to claim 1,
wherein the link member includes a first link member and a second link member each including a rotatable shaft and a sliding shaft, and
wherein the pushing unit includes a first pushing unit and a second pushing unit that independently push the first link member and the second link member, respectively, such that the sliding shaft of each of the first link member and the second link member moves away from the back plate.

5. A key switch device comprising:
a key top;
a link member that guides an elevating operation of the key top while being interlocked with the key top,
the link member including
a rotatable shaft and
a sliding shaft that is connected to the key top;
a membrane sheet that includes a contact that opens and closes in accordance with the elevating operation of the key top;
a back plate;
a housing that holds the rotatable shaft of the link member to the back plate; and
a pushing unit that directly pushes the link member such that the sliding shaft moves away from the back plate,
wherein the link member is provided with a concave portion that houses the respective pushing unit at a bottom dead center of the elevating operation.

6. A method of manufacturing a key switch device comprising:

holding a rotatable shaft of a link member to a back plate by a housing while interposing a membrane sheet between the back plate and the housing, the link member further including a sliding shaft; and while the link member being pushed in a direction away from the back plate by a pushing unit such that the sliding shaft of the link member moves away from the back plate, attaching a key top to the sliding shaft, the link member guiding an elevating operation of the key top, and the membrane sheet including a contact that opens and closes in accordance with the elevating operation of the key top, wherein the pushing unit is a jig including a pin and a spring that pushes the pin such that the pin passing through a through hole that is provided through the back plate pushes the link member.

7. A key switch device comprising:

a key top;

a link member that guides an elevating operation of the key top while being interlocked with the key top, the link member including a rotatable shaft and a sliding shaft that is connected to the key top;

a membrane sheet that includes a contact that opens and closes in accordance with the elevating operation of the key top;

a back plate;

a housing that holds the rotatable shaft of the link member to the back plate;

an elastic force applying unit that is provided at a front surface of the membrane sheet to urge the key top in a direction away from the back plate when the key top is connected to the sliding shaft; and a pushing unit that pushes the link member, independently from the elastic force applying unit and the key top, such that the sliding shaft moves away from the back plate.

8. The key switch device according to claim 7, wherein the link member includes a first link member and a second link member each including a rotatable shaft and a sliding shaft, and wherein the pushing unit includes a first pushing unit and a second pushing unit that independently push the first link member and the second link member, respectively, such that the sliding shaft of each of the first link member and the second link member moves away from the back plate.

9. A key switch device comprising:

a key top;

a link member that guides an elevating operation of the key top, the link member including a rotatable shaft and a sliding shaft that is connected to the key top;

a membrane sheet that includes a contact that opens and closes a contact in accordance with the elevating operation of the key top;

a back plate; and a housing that includes leg portions to hold the rotatable shaft of the link member to the back plate, wherein the back plate is provided with a through hole at a position corresponding to the link member near the rotatable shaft, the position where the through hole is provided being different from positions where the leg portions of the housing are provided.

10. The key switch device according to claim 9, wherein the link member includes a first link member and a second link member each including a rotatable shaft and a sliding shaft, and wherein the pushing unit includes a first pushing unit and a second pushing unit that independently push the first link member and the second link member, respectively, such that the sliding shaft of each of the first link member and the second link member moves away from the back plate.

* * * * *